United States Patent [19]

Bird

[11] Patent Number: 4,975,083

[45] Date of Patent: Dec. 4, 1990

[54] CABLE ASSEMBLY WITH OVERMOLD RELEASE PREVENTION

[75] Inventor: Philip S. Bird, Lancaster, Pa.

[73] Assignee: AMP Incorporated, Harrisburg, Pa.

[21] Appl. No.: 463,583

[22] Filed: Jan. 11, 1990

[51] Int. Cl.[5] ..... H01R 13/56

[52] U.S. Cl. ..... 439/606

[58] Field of Search ..... 439/604–606, 439/736, 449, 460, 470, 445, 447

[56] References Cited

U.S. PATENT DOCUMENTS

| | | | |
|---|---|---|---|
| Re. 26,646 | 8/1969 | Evans | 428/584 |
| Re. 26,837 | 3/1970 | Evans | 361/393 |
| 4,089,041 | 8/1975 | Lockard | 361/403 |
| 4,579,404 | 4/1986 | Lockard | 339/14 R |
| 4,596,428 | 3/1984 | Tengler | 339/14 R |
| 4,602,830 | 9/1984 | Lockard | 339/14 R |
| 4,602,831 | 8/1985 | Lockard | 339/14 R |
| 4,655,515 | 7/1985 | Hamsher et al. | 339/14 R |
| 4,679,870 | 7/1987 | Pretchel | 439/736 |
| 4,682,840 | 4/1986 | Lockard | 439/874 |
| 4,737,117 | 4/1988 | Lockard | 439/449 |
| 4,834,674 | 6/1988 | Beamenderfer et al. | 439/494 |

FOREIGN PATENT DOCUMENTS

| | | | |
|---|---|---|---|
| 568767 | 4/1945 | United Kingdom | 439/736 |

*Primary Examiner*—Gary F. Paumen

*Attorney, Agent, or Firm*—Gerald K. Kita

[57] ABSTRACT

An electrical cable assembly 1 comprises, conductive electrical contacts in an insulative housing block 4 connected to corresponding wires of an electrical cable 2, and insulative material 10 adhered to an end of the housing and embedding the cable 2, at least one channel 16 in the housing block 4 facing a rear end 14 of the housing block 4 and forming therein a peg 25 of the insulative material 10, the channel 16 having undercut side walls 23, and the peg 25 is locked against the undercut side walls 23 despite contraction of the insulative material 10 during solidification.

6 Claims, 4 Drawing Sheets

CABLE ASSEMBLY WITH OVERMOLD RELEASE PREVENTION

FIELD OF THE INVENTION

The invention relates to an electrical cable assembly according to which, electrical contacts are mounted in an insulative housing, and are connected to signal wires and ground wires of an electrical cable.

BACKGROUND OF THE INVENTION

A cable assembly is known from U.S. Pat. No. 4,834,674, and includes plastic insulative material which imbeds the cable where the cable exits from the housing block. The insulative material is flowed in place to fill spaces between the wires and to cover open ends of cavities at a rear end of the housing block. The insulative material is solidified to fix the wires in place.

It is desirable for the insulative material to adhere to the housing block after being solidified. The insulative material forms a strain relief for the wires and would provide a seal adhered to the end of the housing block. Attempts to improve adherence of the insulative material has been unsuccessful, because the housing block and the insulative material are fabricated of dissimilar materials not readily adhered to each other, and because the insulative material tends to contract during solidification to become separated from the housing block. Separation is more pronounced when, during use of the cable assembly, the insulative material is subjected to repeated stress and strain, for example, during repeated bending of the wires near where they join the insulative material.

SUMMARY OF THE INVENTION

An object of the invention is to prevent molded insulative material from separating from a housing block of a connector. The object is achieved by providing the housing block with a channel having undercut side walls, and by molding the insulative material into the slot, such that the insulative material solidifies and locks against the undercut side walls formed in the housing block. The advantage is that the insulative material is locked against undercut side walls of the housing block in spite of the insulative material shrinking during solidification, and being subjected to repeated stress and strain during use of the cable assembly.

To obtain a further understanding of the invention, reference will now be made by way of example to the accompanying drawings.

DETAILED DESCRIPTION OF THE INVENTION

Figure 2:
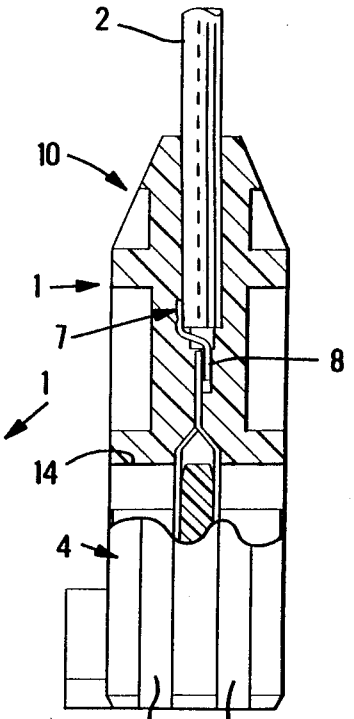
FIG. 2 is a section view taken along the line 2—2 of FIG. 1.
Figure 1:
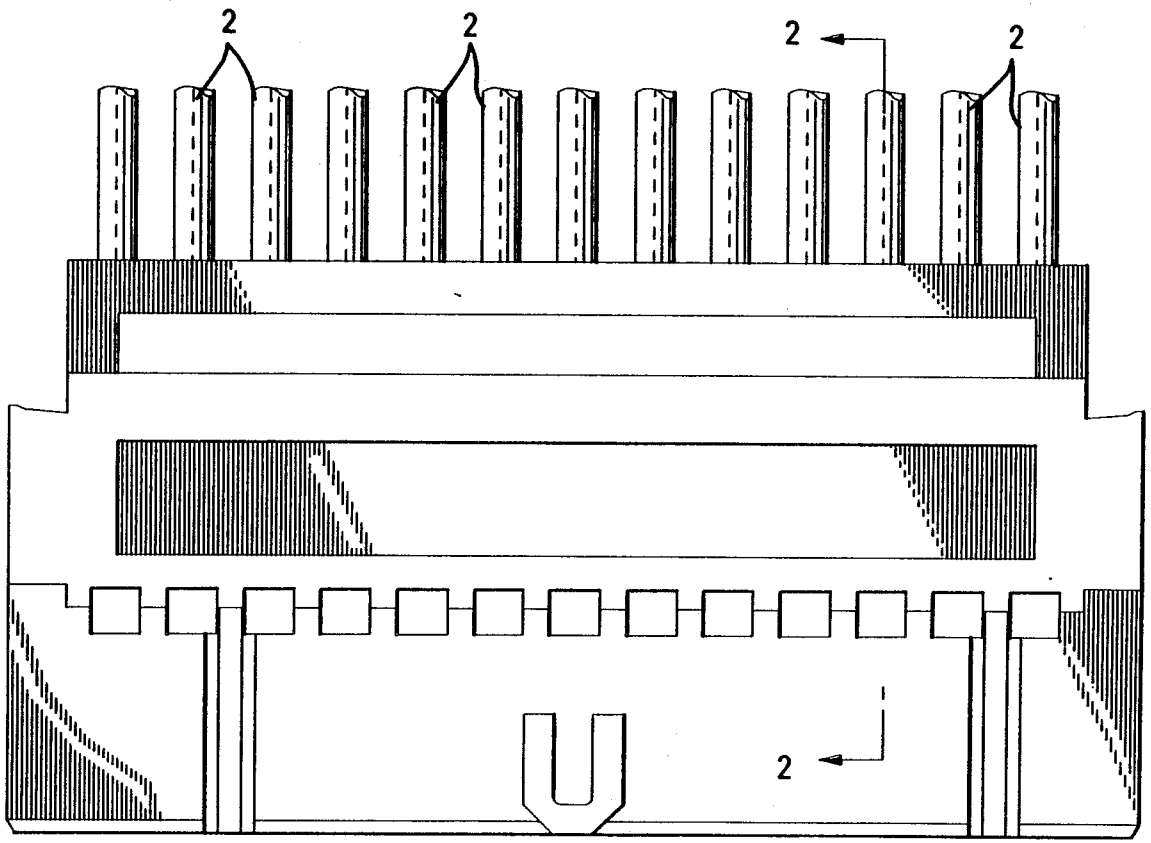
FIG. 1 is a fragmentary view of a cable assembly according to the invention.
Figures 2A, 2B, 2C:
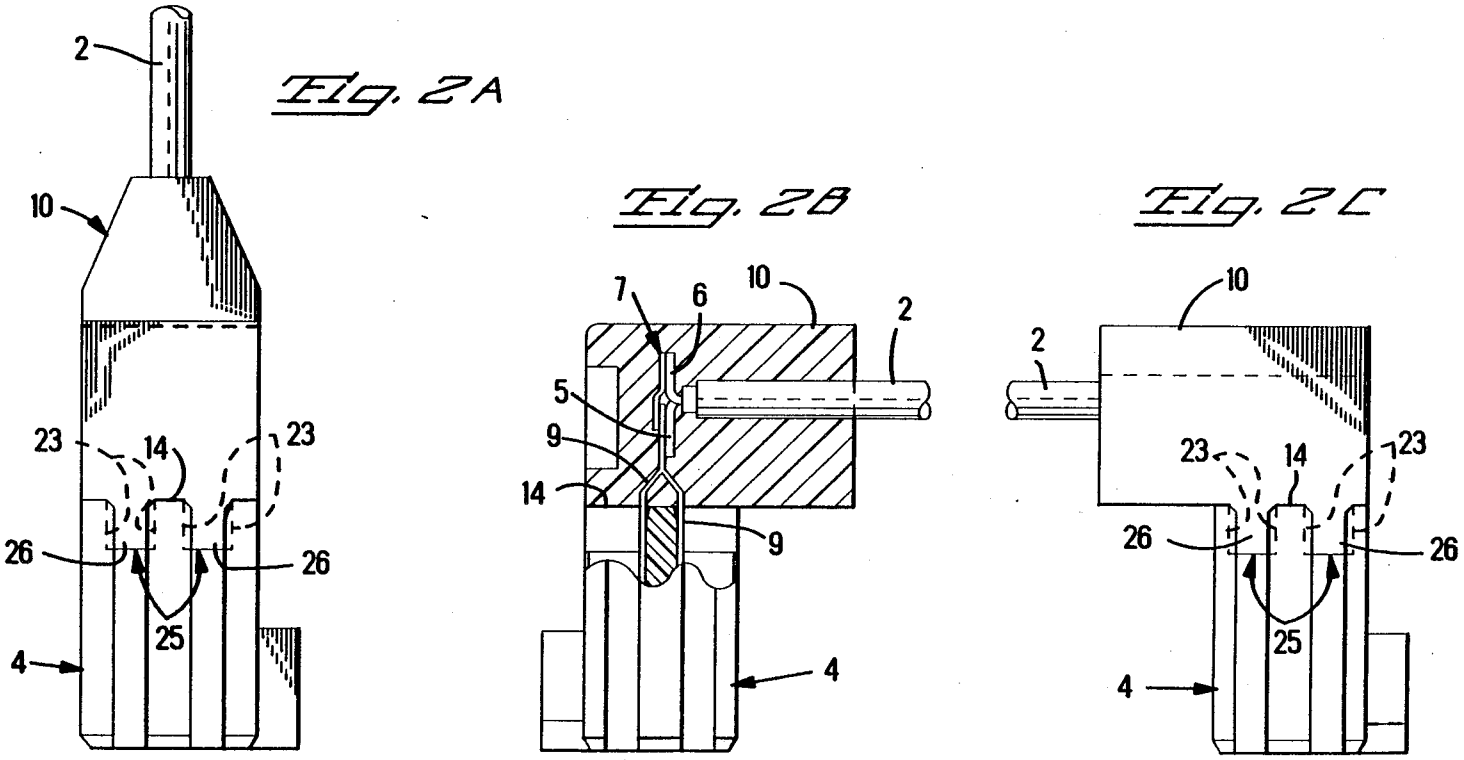
FIG. 2A is an end elevation view of the structures shown in FIG. 1.
FIG. 2B is a section view, similar to FIG. 2, of an alternate structure for the cable assembly shown in FIG. 2.
FIG. 2C is a view similar to FIG. 2A, of the alternate structure shown in FIG. 2B.
Figure 3:
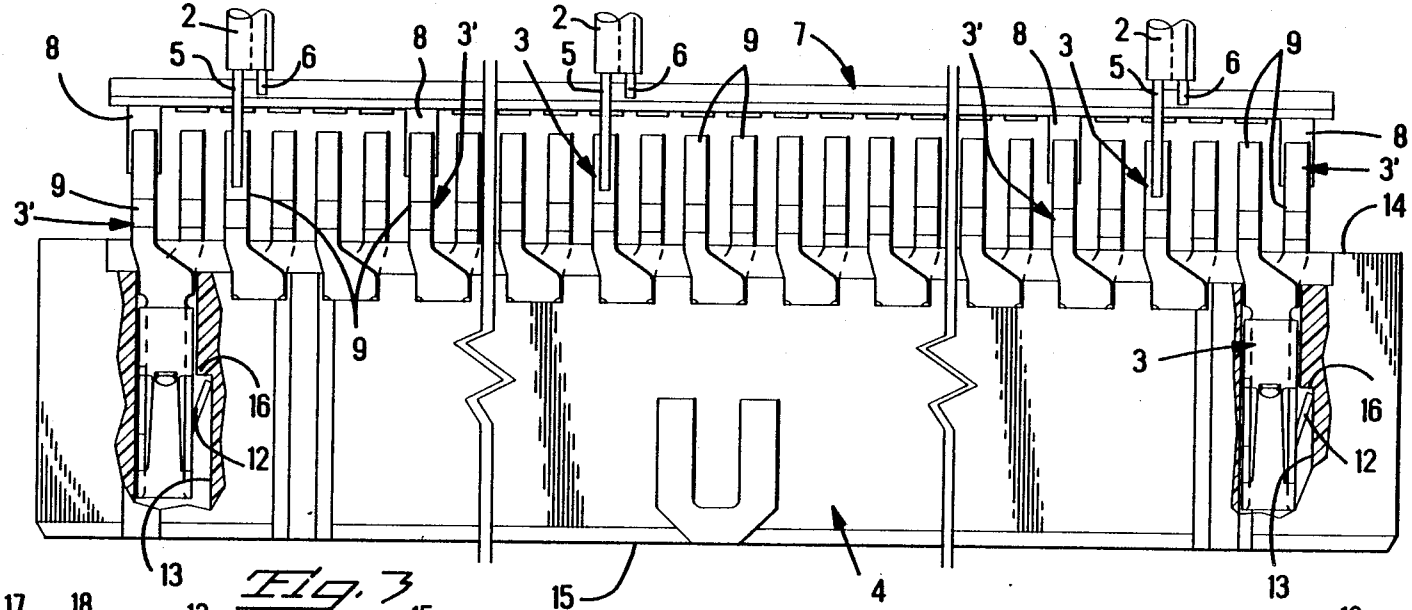
FIG. 3 is an elevation view of a connector block, contacts and a ground bus.

With more particular reference to FIGS. 1, 2 and 3, an electrical cable assembly 1 for at least one electrical cable 2 comprises, electrical contacts 3 mounted in an insulative housing block 4. Although multiple cables 2 are shown, the cables 2 can be combined into a lesser number of cables 2. Each cable 2 includes at least one signal wire 5, and at least one ground wire 6. A conductive ground bus 7 includes unitary tabs 8 joined to selected contacts 3', for example, by welding, as disclosed in U.S. Pat. No. 4,834,674, to corresponding wire connecting portions 9 of the selected contacts 3'. Further, according to the Patent, corresponding signal wires 5 are connected to the wire connecting portions 9 of corresponding contacts 3, corresponding ground wires 6 are connected to the ground bus 7 and overmold in the form of plastic insulative material 10 is molded in place to cover the wire connecting portions 9 and the ground bus 7. Each cable 2 exits a rear of the insulative material 10, as in FIGS. 2 and 2A, or exits a side of the insulative material 10, as in FIGS. 2B and 2C.

Figure 7:
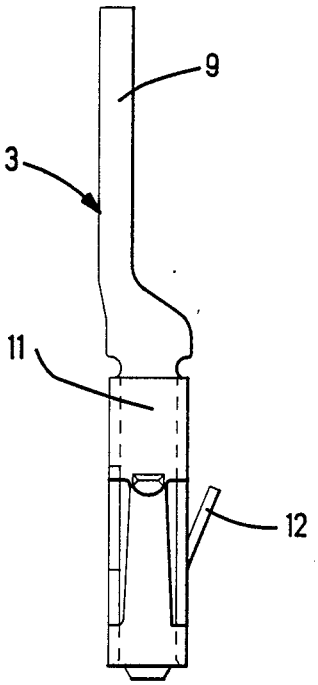
FIG. 7 is an elevation view of one of the contacts shown in FIG. 3.
Figure 8:
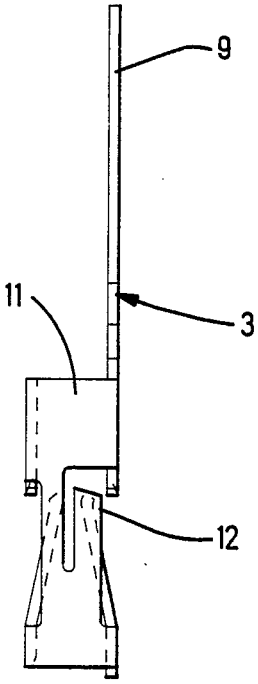
FIG. 8 is an end elevation view of the contact shown in FIG. 7.

Each contact 3 is described by reference to FIGS. 7 and 8 and includes, an electrical receptacle 11 having a unitary lance 12 being unitary with a corresponding wire connecting portion 9. The receptacle 11 is more particularly described in U.S. Pat. Re. 26,646 and Re. 26,837.

With reference to FIG. 3, each receptacle 11 is received in a corresponding contact receiving cavity 13 of the housing block 4, within a row of cavities 13. The wire connecting portion 9 of each contact 3 projects outwardly from a rear end 14 of the housing block 4, and an open end of the receptacle 11 of each contact 3 faces toward a front end 15 of the housing block 4. The lance 12 of each contact 3 opposes a shoulder 16 internally of a corresponding cavity 13 to resist movement of the contact 3.

The insulative material 10 embeds the cable 2 where the cable 2 exits from the housing block 4. The insulative material 10 is flowed in place to fill spaces between the wires 5, 6 and to cover open ends of cavities 13 at the rear end 14 of the housing block 4. The insulative material 10 is solidified to fix the wires 5, 6 in place. The insulative material 10 tends to contract during solidification, and consequently tends to become separated from the rear end 4 housing block 4. Separation is more pronounced when, during use of the cable assembly 1, the insulative material !0 is subjected to repeated stress and strain, for example, during repeated bending of the cables 2 near where they join the insulative material 10. The housing block 4 is fabricated from a suitable thermosetting plastic material and is rigid when the insulative material 10 is flowed against the rear end 14 of the housing block 4. The insulative material 10 is dissimilar to the material of the housing block 4, and the two materials do not readily adhere to each other, particularly when the material of the housing block 4 is resistant to remelting from its solidified form.

Figure 4:
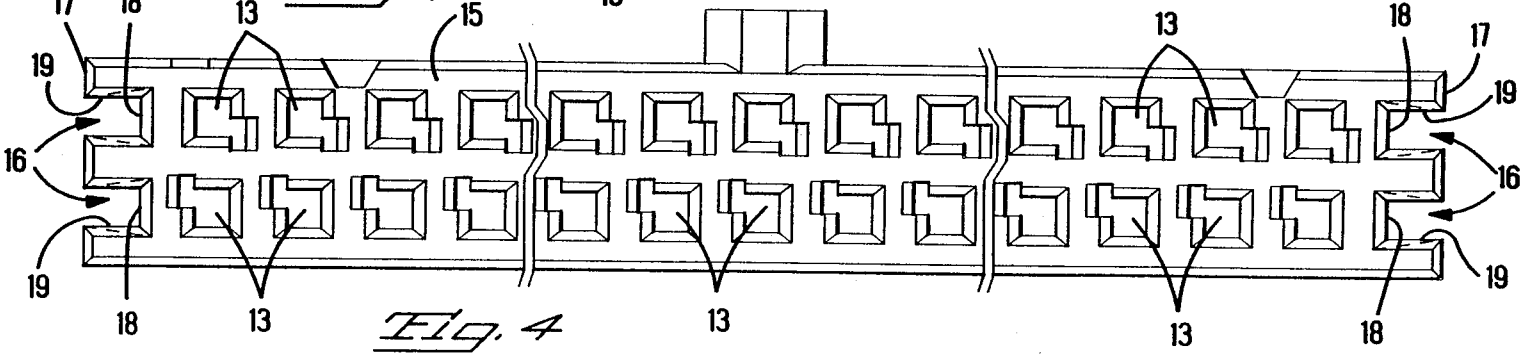
FIG. 4 is a bottom plan view of the structure shown in FIG. 3.
Figure 6:
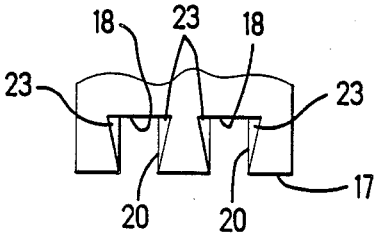
FIG. 6 is a fragmentary plan view of the connector block shown in FIG. 5.
Figure 5:
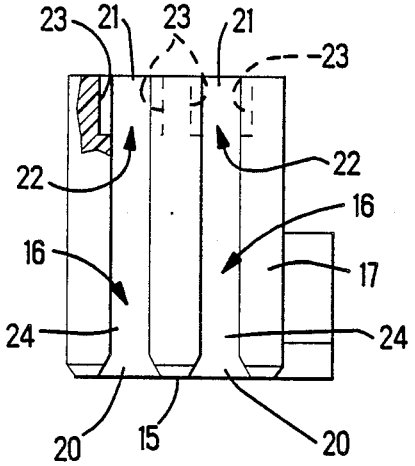
FIG. 5 is an end view of the connector block shown in FIG. 4.

With reference to FIGS. 4, 5 and 6, another feature of the invention will be described. The housing block 4 is provided with at least one channel 16, for example, a channel 16 at each end of each row of cavities 13 and adjacent to a corresponding lateral end 17 of the housing block 4.

Each channel 16 will now be described with reference to FIGS. 4, 5 and 6. A closed side 18 of the channel 16 separates the channel 16 from the cavities 13, such that the closed side 18 prevents the flow of insulative material 10 toward the cavities 13. The channel 16 has open sides 19, 20 and 21 that open into, respectively, an exterior surface of the housing block 4 at the lateral end 17, at the front end !5 and at the rear end 14 of the housing block 4. The insulative material 10 can flow into the channel 16 from the open side 21 at the rear end 14. Gasses that might be entrapped, and that would resist the flow of insulative material 10, are expelled outwardly of the open sides 20 and 21 of the channel 16.

A rear portion 22 of each channel 16 is provided with opposed, facing undercut side walls 23 that diverge, and that extend from the closed side 18 of the channel 16 toward the open side 20 at the lateral end 17 of the housing block 4. The insulative material 10 is flowed to fill the rear portion 22, leaving a front portion 24 of the channel 16 open, FIGS. 2 and 2A. The front portion 24 is of lesser cross section than that of the rear portion 22. Advantageously, the lesser cross section and, the heretofore described, open construction of the channel 16, easily accept a form barrier, not shown, to be inserted into the front portion 24 of the channel 16 and against the exterior surface of the lateral end 17 to confine the flow of insulative material 10 and to define exterior surfaces of the insulative material 10 while such material solidifies.

The insulative material 10 contracts in volume as it solidifies. Such contraction would have caused the insulative material 10 to separate from the rear end 14 of the housing block 4. However, the insulative material 10 flows to fill the rear portion 22 of the channel 16 and bridges across a gap separating the undercut side walls 23. The insulative material 10 solidifies in the rear portion 22 to form a rigid peg 25 of tapered cross section. Even though the cross section of insulative material 10 has contracted, such contraction is located at the least cross section on an exterior, laterally facing edge 26 of the peg 25. Such edge 26 is also the exterior edge 26 of the insulative material 10. The remainder of the cross section of the peg 25 will remain substantially free from contraction and will remain bridged between the side walls 23 and locked against the side walls 23.

In use, the cable assembly 1 is plugged over known conductive pins, not shown, spaced apart equally in a grid of rows and columns. The pins are received in corresponding receptacles 11 to provide disengageable electrical connections. One of the pins is received along the open, front portion 24 of the channel 16. This will allow the cable assembly 1 to plug anywhere within the grid of pins without clashing with the pins.

I claim:

1. An electrical cable assembly comprises, conductive electrical contacts in an insulative housing block connected to corresponding wires of an electrical cable, and insulative material adhered to an end of the housing and embedding the cable, wherein the improvement comprises:

at least one channel in the housing block facing a rear end of the housing block and receiving part of the insulative material therein, the channel having undercut side walls, the insulative material when solidified being locked against the undercut side walls despite contraction of the insulative material during solidification, the channel is open to an exterior surface of the housing block, and the channel does not have a contact therein.

2. An electrical cable assembly as recited in claim 1, wherein the improvement comprises:

the housing block and the insulative material are fabricated of dissimilar materials.

3. An electrical cable assembly as recited in claim 1, wherein the improvement comprises:

the insulative material bridges between the side walls.

4. An electrical cable assembly as recited in claim 1, wherein the improvement comprises:

a closed side of the channel separates the channel from cavities in the housing constructed to receive corresponding contacts.

5. An electrical cable assembly as recited in claim 1, wherein the improvement comprises:

a row of cavities in the housing block receiving corresponding contacts, and the channel is at an end of the row and adjacent to a corresponding end of the housing block.

6. An electrical cable assembly as recited in claim 1, wherein the improvement comprises:

pegs of the insulative material extend along corresponding said channels and projecting in opposite directions to opposite external edges of the insulative material.

* * * * *